US006382478B2

(12) United States Patent
Gouldson et al.

(10) Patent No.: US 6,382,478 B2
(45) Date of Patent: May 7, 2002

(54) le;.5qGARMENT HANGER HAVING A REMOVABLE SIZE INDICATOR

(75) Inventors: Stanley F. Gouldson, Northport; Olaf Olk, Hauppauge, both of NY (US)

(73) Assignee: Spotless Plastics Pty. Ltd., Victoria (AU)

( * ) Notice: Subject to any disclaimer, the term of this patent is extended or adjusted under 35 U.S.C. 154(b) by 0 days.

(21) Appl. No.: 09/852,190

(22) Filed: May 9, 2001

Related U.S. Application Data

(60) Division of application No. 09/571,603, filed on May 15, 2000, now Pat. No. 6,260,745, which is a continuation-in-part of application No. 09/479,170, filed on Jan. 7, 2000, now Pat. No. 6,264,075.

(51) Int. Cl.[7] ..... A47G 25/14
(52) U.S. Cl. ..... 223/85; 40/322
(58) Field of Search ..... 223/85, 92, 88; 40/322

(56) References Cited

U.S. PATENT DOCUMENTS

| | | | |
|---|---|---|---|
| 1,321,926 | A | 11/1919 | Landry |
| 1,389,266 | A | 8/1921 | Newton |
| 2,166,492 | A | 7/1939 | Harvey |
| 2,857,696 | A | 10/1958 | Barrow |
| D192,845 | S | 5/1962 | Cohen |
| 3,535,808 | A | 10/1970 | Morrish |
| 3,949,914 | A | 4/1976 | Ostroll |
| 4,006,547 | A | 2/1977 | Samuels et al. |
| 4,045,899 | A | 9/1977 | Richardson |
| 4,115,940 | A | 9/1978 | Phillips |
| 4,198,773 | A | 4/1980 | Batts et al. |
| 4,450,639 | A | 5/1984 | Duester |
| 4,997,114 | A | 3/1991 | Petrou |
| 5,096,101 | A | 3/1992 | Norman et al. |
| 5,199,608 | A | 4/1993 | Zuckerman |
| 5,238,159 | A | 8/1993 | Zuckerman |
| 5,305,933 | A | 4/1994 | Zuckerman |
| 5,383,583 | A | 1/1995 | Zuckerman |
| 5,388,354 | A | 2/1995 | Marshall et al. |
| 5,407,109 | A | 4/1995 | Zuckerman |
| 5,441,182 | A | 8/1995 | Sullivan |
| 5,449,099 | A | 9/1995 | Blanchard |
| 5,469,995 | A | 11/1995 | Bredweg et al. |
| 5,477,995 | A | 12/1995 | Dooley et al. |
| 4,322,902 | A | 1/1996 | Lenthall |
| 5,485,943 | A | 1/1996 | Zuckerman |
| 5,503,310 | A | 4/1996 | Zuckerman |
| 5,524,801 | A | 6/1996 | Dooley et al. |
| 5,573,151 | A | 11/1996 | Fildan |
| 5,586,697 | A | 12/1996 | Johansson |
| 5,590,822 | A | 1/1997 | Zuckerman |
| 5,597,100 | A | 1/1997 | Blitz |
| 5,603,437 | A | 2/1997 | Zuckerman |
| 5,611,469 | A | 3/1997 | Eiley et al. |
| 5,613,629 | A | 3/1997 | Zuckerman |
| 5,641,100 | A | 6/1997 | Mitchell et al. |
| 5,642,840 | A | 7/1997 | Abdi |
| 5,683,018 | A | 11/1997 | Sullivan et al. |
| 5,687,887 | A | 11/1997 | Bond et al. |
| 5,775,553 | A | 7/1998 | Marshall et al. |
| 5,778,575 | A | 7/1998 | Deupree et al. |
| 5,819,995 | A | 10/1998 | Zuckerman |
| 5,857,276 | A | 1/1999 | Marshall et al. |
| 5,913,462 | A | 6/1999 | Petrou |
| 5,950,883 | A | 9/1999 | Bond et al. |
| 6,019,260 | A | 2/2000 | Gouldson et al. |
| 6,029,868 | A | 2/2000 | Willinger et al. |
| 6,041,983 | A | 3/2000 | Sullivan et al. |

*Primary Examiner*—Bibhu Mohanty
(74) *Attorney, Agent, or Firm*—Scully, Scott, Murphy & Presser

(57) ABSTRACT

A garment hanger having a releasable size indicator. The garment hanger including a hook for suspending the hanger on a support and a body connected to the hook; the hanger having at least one web for removably securing a size indicator to the hanger, the web having a fixed latch and a pivoting latch; and a size indicator having at least one engagement abutment and fingers for engaging the fixed and pivoting latches such that the size indicator is secured on the web during normal use, but wherein the size indicator may be released from the web when the pivoting latch is pivoted out of engagement with the fingers of the size indicator.

1 Claim, 9 Drawing Sheets

GARMENT HANGER HAVING A REMOVABLE SIZE INDICATOR

CROSS REFERENCE TO RELATED APPLICATIONS

This present application is a divisional of application U.S. Ser. No. 09/571,603 filed on May. 15, 2000 now U.S. Pat. No. 6,260,745 which is a continuation-in-part of U.S. Ser. No. 09/479,170 filed Jan. 7, 2000 now U.S. Pat. No. 6,264,075.

BACKGROUND OF THE INVENTION

1. Field of the Invention

The present invention relates generally to a garment hanger of the type having a removable size indicator and, more particularly, to a garment hanger having a size indicator which may be removed by way of a tool which engages a pivoting latch.

2. Prior Art

U.S. Pat. No. 3,949,914 illustrates a hanger with a modified hook which accepts a size indicator which clips onto one of the flanges which define the hook structure.

U.S. Pat. No. 4,115,940 illustrates a hanger having a size indicator or sizing tab which attaches to a tab mounting member mounted between the hanger hook and the hanger body. Hangers having size indicators mounted in this position are generally referred to in the trade as side sizers.

U.S. Pat. No. 4,322,902 illustrates a hanger having a display portion formed at the top of the hook which may accept two different types of size indicators. One type fastens to the display portion like a tie-tac, and the other slips over the top of the display portion. Hangers having size indicators mounted in this position are generally referred to in the trade as top sizers.

U.S. Pat. No. 5,485,943 is typical of a number of patents which disclose one or more means to prevent inadvertent removal of the side sizer by blocking access to the edges of the side sizer, thereby preventing young children from obtaining "finger purchase" on the edge of the side sizer to pry it off.

U.S. Pat. Nos. 5,469,995; 5,778,575; 5,469,995; 5,096,101; 5,950,883; 5,683,018; 5,642,840; 5,611,469; and 5,407,109 all illustrate hangers having various means to make the side sizer "substantially unremovable" or "irremovable" once the sizing tab engages the tab holder on the hanger. The intent is to make the hanger and sizing system "child proof", and thereby prevent a child from inadvertently removing the tab, and swallowing or choking on the side sizer.

U.S. Pat. No. 5,449,099 is one of several patents on a hanger and side sizer system that provides a tool for removing the side sizer if it is inadvertently applied, or if the hanger is later used to hang a garment of a different size. Multiple cuts are provided through the security rib and the attachment member to enable a special tool to pry the indicator from the hanger.

U.S. Pat. No. 5,687,887 illustrates another design for a hanger and side sizer that enables a special tool to slide through cuts in the security rib and thereby remove the side sizer.

U.S. Pat. No. 5,794,363 illustrates a hanger hook adapted to receive a top sizer, which hanger hook has a resilient detent engagement means for securing the top sizer which enables the top sizer to be automatically removed for re-use of the hanger.

SUMMARY OF THE INVENTION

It is an object of the present invention to provide a garment hanger with a novel size indicator and indicator attachment mechanism.

It is a further object of the present invention to provide a garment hanger with a removable size indicator.

It is yet a further object of the present invention to provide a garment hanger with a removable size indicator that may be mounted on the top of the hook or at the side of the hook.

It is still yet a further object of the present invention to provide a garment hanger with a removable size indicator that is securely affixed to the hanger during use, and is thereby "child proof", yet which may be quickly and easily removed with a tool when it is desired to re-use the hanger with a garment of a different size.

Accordingly, a garment hanger having a removable size indicator is provided. The garment hanger comprises: a hanging means for suspending the hanger on a support and a body connected to the hanging means; the hanger having at least one web for removably securing a size indicator to the hanger, the web having a fixed latch and a pivoting latch; and a size indicator having finger means for engaging the fixed and pivoting latches such that the size indicator is secured on the web, wherein the size indicator is released from the web when the pivoting latch is pivoted out of engagement with the finger means of the size indicator.

In a preferred implementation of the garment hanger of the present invention, the size indicator further comprises at least one engagement abutment disposed on an inner surface of the size indicator. More preferably, the at least one engagement abutment comprises a first engagement abutment disposed on a first inner surface of the size indicator and a second engagement abutment disposed on a second inner wall of the size indicator.

In another preferred implementation of the garment hanger of the present invention, the hanging means is a hook and the web is located at either, a junction between the hook and the body, at a top portion of the hook, or at both locations.

In yet another preferred implementation of the garment hanger of the present invention, the pivoting latch is located at a central portion of the web and the fixed latch is located on at least one end of the pivoting latch. Preferably, the fixed latch is located on each end of the pivoting latch, with the pivoting latch projecting from a first side of the web and the fixed latch projecting from an opposite side of the web.

In still yet another preferred implementation of the garment hanger of the present invention, the pivoting latch is defined by a slot cut through the web, the slot having a shape defined by at least two sides, the pivoting latch being further defined by a living hinge closing the shape of the slot. Preferably, the slot is two sided and the living hinge closes the shape of the slot thereby forming a triangular shaped pivoting latch. The pivoting latch further having an engagement means for facilitating the pivoting of the pivoting latch. Preferably, the engagement means comprises a cantilevered end of the pivoting latch which when a releasing force is applied thereto provides a mechanical advantage for pivoting the pivoting latch out of engagement with at least one engagement abutment and finger means of the size indicator. The web further has a guard extending across the web and below the size indicator, the guard having a down-turned portion which follows the contours of the cantilevered end. The guard protects the cantilevered end from inadvertent actuation. The cantilevered end preferably has engagement means adapted to receive a tool used for application of the releasing force. The engagement means is preferably a dimple formed on a side of the cantilevered end.

In a preferred implementation of the garment hanger of the present invention, the size indicator preferably has a face and two sides depending therefrom, each of the sides terminating in a foremost edge, the foremost edges being configured such that the cantilevered end of the pivoting latch is exposed when the size indicator is secured on the web. The finger means of the size indicator preferably comprises an inwardly facing ridge disposed at each of the foremost edges and projecting inwards towards the channel. The at least one engagement abutment is preferably disposed on each of an inner surface of the two sides between the face and the foremost edge.

In yet another preferred implementation of the garment hanger of the present invention, the web further comprises an outermost edge having an outermost portion of a predetermined cross-section, the size indicator having a pair of spaced projections projecting from an inner surface of the face and substantially configured to receive an outermost portion of the web therebetween for preventing a lateral movement of the size indicator when the size indicator is secured on the web.

In still yet another preferred implementation of the garment hanger of the present invention, the web further comprises locating guides for locating the size indicator in a predetermined position on the web. The locating guides preferably comprise first and second guides disposed on each of the side edges of the size indicator and spaced apart to fit the size indicator therein to center the size indicator between the guides when it is applied. Preferably each of the first and second guides do not extend the full length of the side of the size indicator.

Still yet provided is a size indicator to be removably secured to a web of a garment hanger. The size indicator comprises a face and two sides depending therefrom defining a channel, each of the sides terminating in a foremost edge, an inner surface of the face having a pair of spaced projections substantially configured to receive an outermost portion of the web therebetween for preventing a lateral movement of the size indicator when the size indicator is secured on the web. Each of the sides have at least one engagement abutment disposed between the face and foremost edge and an inwardly facing ridge disposed at each of the foremost edges and projecting inwards towards the channel for engaging a fixed ridge and a pivoting ridge on the web. The cross section of the size indicator enables the size indicator to be extruded and then cut into sections. The indicators may be printed before or after cutting. This process substantially lowers the cost of producing size indicators as compared to the cost of producing indicators which must be individually molded.

In one embodiment of the invention, a hanger hook is provided which has provisions for receiving either a side sizer or a top sizer as desired. This reduces the inventory of hangers required for a garment manufacturer who ships to both types of retail environments, i.e., retail stores which desire side sizers, and those who desire top sizers. Alternately, if desired, both could be affixed to the hook. In this embodiment, the top sizer is longer than the side sizer to provide greater visibility and visual harmony with other top sizer hangers, although the top web and the side web could be formed to receive the same length of size indicator, thereby allowing the manufacturer to use the same size indicator as either a side sizer or a top sizer.

BRIEF DESCRIPTION OF THE DRAWINGS

These and other features, aspects, and advantages of the apparatus of the present invention will become better understood with regard to the following description, appended claims, and accompanying drawings where:

FIG. 2(*b*) illustrates a top view of the size indicators of FIGS. 2(*a*) and 2(*c*).

FIG. 3(*b*) illustrates the enlarged view of the web of FIG. 3*a* with a size indicator secured thereon.

FIG. 6(*b*) illustrates a partial sectional view of the web of FIG. 3 as taken along line 5—5 thereof and additionally having the second version of the size indicator secured thereon.

FIG. 7(*b*) illustrates the first web and second version of the first embodiment of the size indicator of FIG. 6(*b*) wherein the pivoting latch is being pivoted to release the size indicator therefrom.

FIG. 9(*b*) illustrates a side view of the size indicators of FIGS. 9(*a*) and 9(*c*).

DETAILED DESCRIPTION OF THE PREFERRED EMBODIMENT

Although this invention is applicable to numerous and various types of hangers, it has been found particularly useful in the environment of garment hangers having a hook for suspending the garment hanger from a display. Therefore, without limiting the applicability of the invention to these types of hangers, the invention will be described in such environment.

Figure 1:
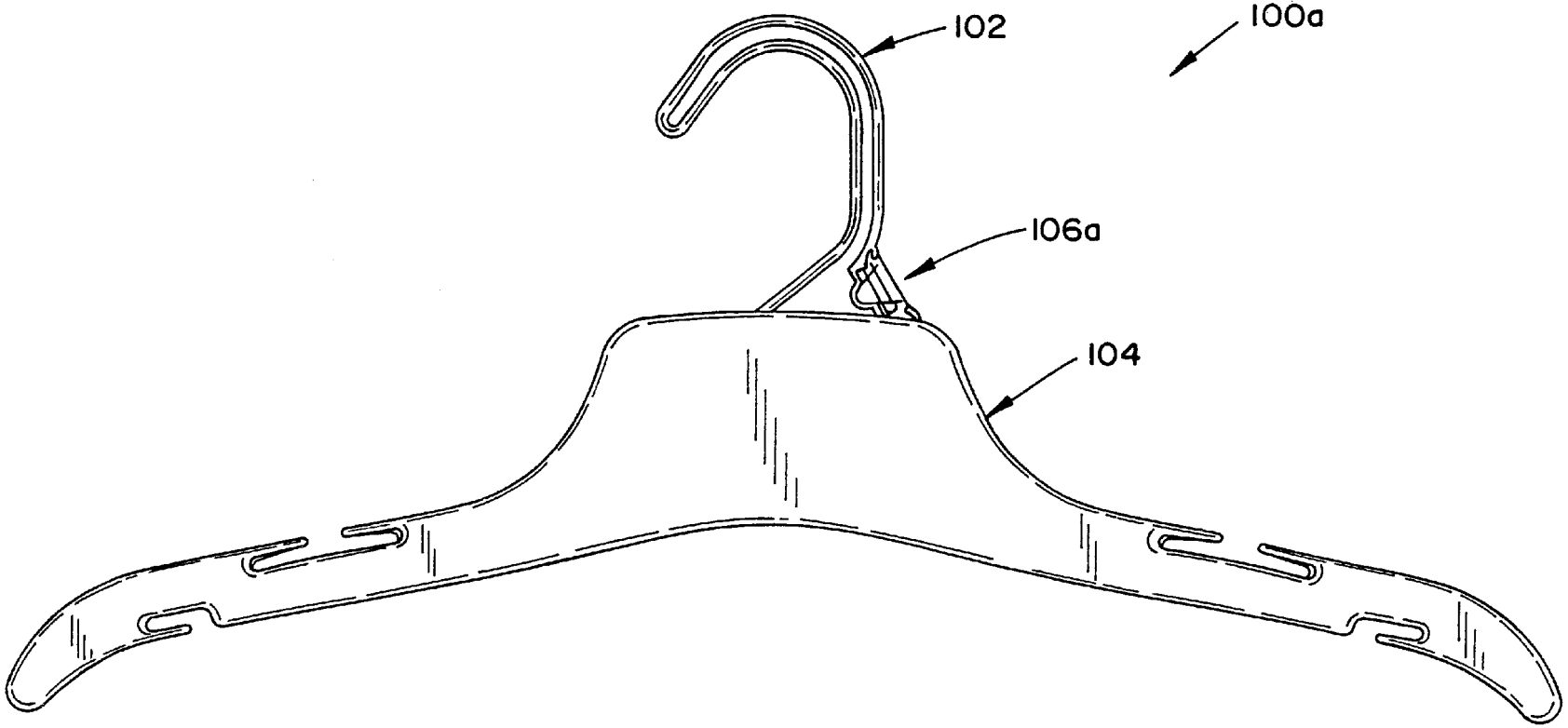
FIG. 1 illustrates a first embodiment of a garment hanger of the present invention having a first web at a junction between the hook and body of the garment hanger.
Figure 8:
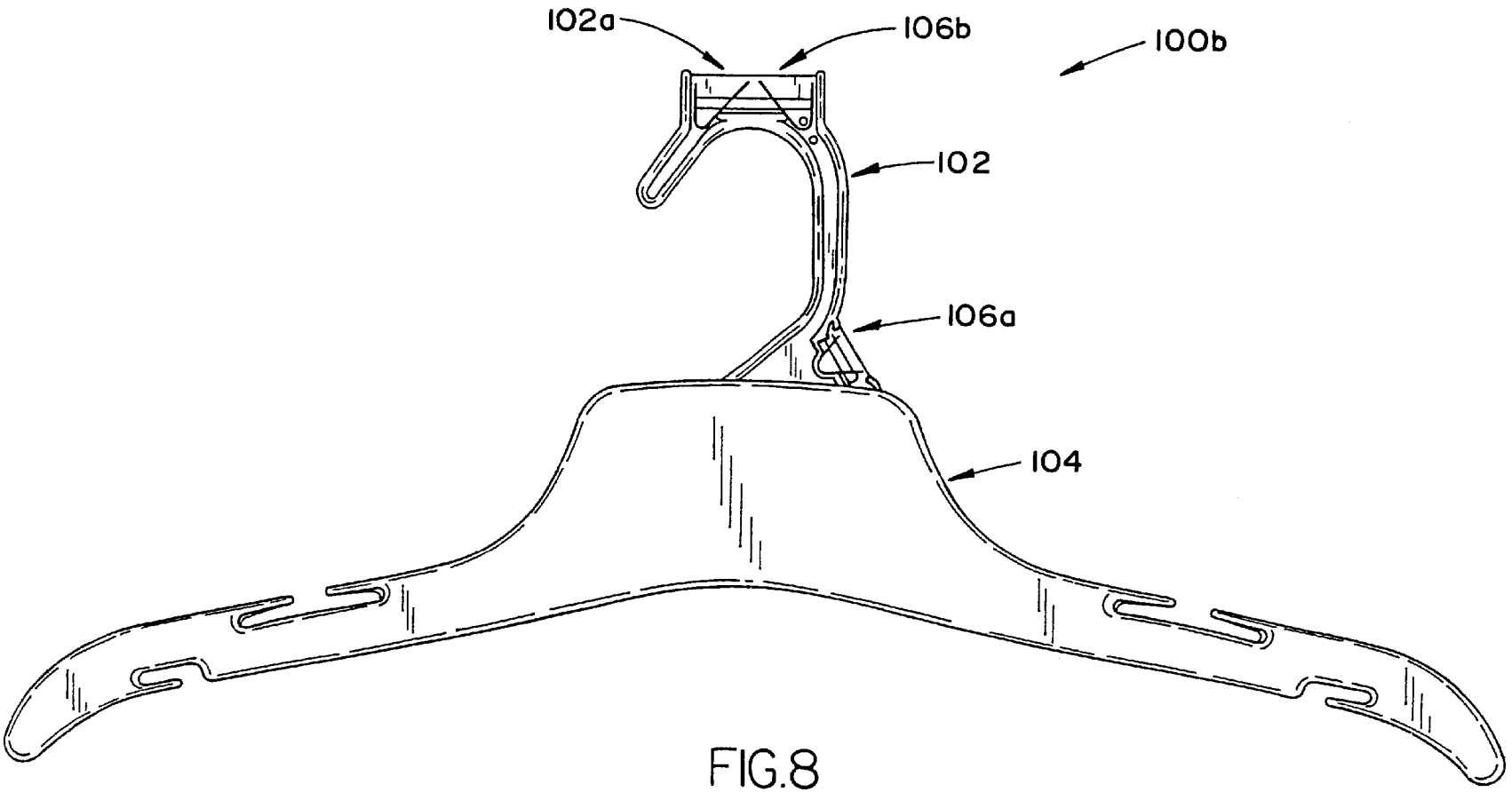
FIG. 8 illustrates a second embodiment of a garment hanger of the present invention having the first web at a junction between the hook and body of the garment hanger and a second web at a top portion of the hook.

Referring now to FIG. 1, there is illustrated a first embodiment of the garment hanger of the present invention, generally referred to by reference numeral 100*a*. The garment hanger 100*a* has a hanging means, such as a hook 102, for supporting the hanger 100*a* on a display (not shown). The hanger 100*a* further having a body 104 connected to the hook 102. The body has at least one web 106*a* for removably securing a first version of a first embodiment of a size indicator 108*a* (FIG. 2*a*) to the body 104. In a first embodiment of the garment hanger of the present invention, illustrated in FIG. 1, the web 106*a* is located at a junction between the hook 102 and the body 104. As will be discussed below with regard to FIG. 8, in a second embodiment of the garment hanger of the present invention, generally referred to by reference numeral 100*b*, the web 106*b* can be alternatively located at a top portion 102*a* of the hook 102. Furthermore, as will be discussed below with regard to FIG. 11, in a third embodiment of the garment hanger of the present invention, generally referred to by reference numeral 100*c*, the web 106*b* can be alternatively located at both the junction between the hook 102 and the body 104 and at the top portion 102*a* of the hook 102.

Figure 3B:
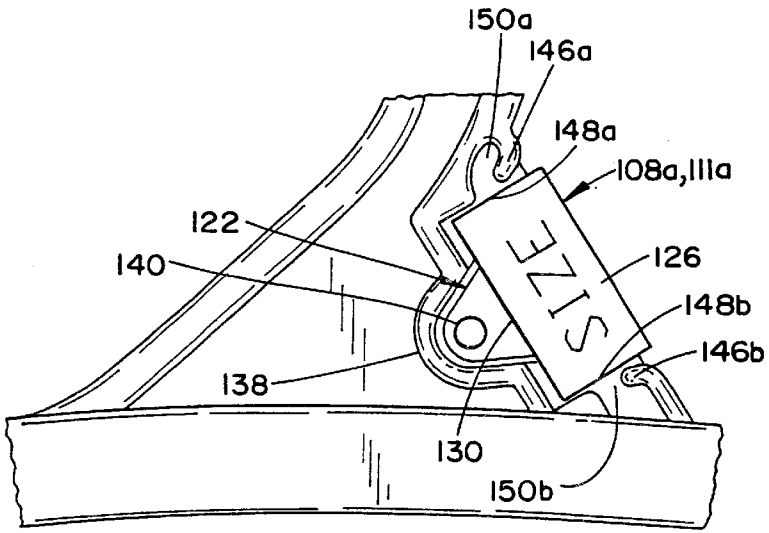
FIG. 3(*a*) illustrates an enlarged view of the first web of FIG. 1.
Figure 3A:
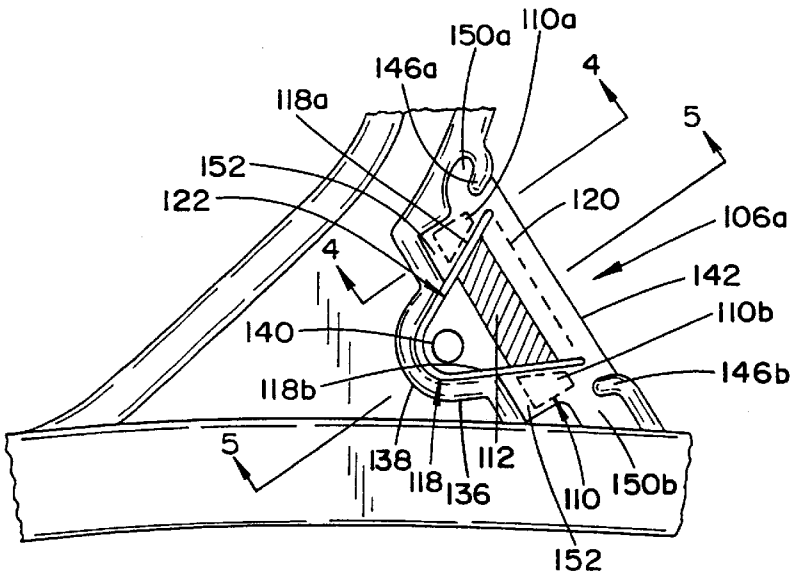
Figure 4:
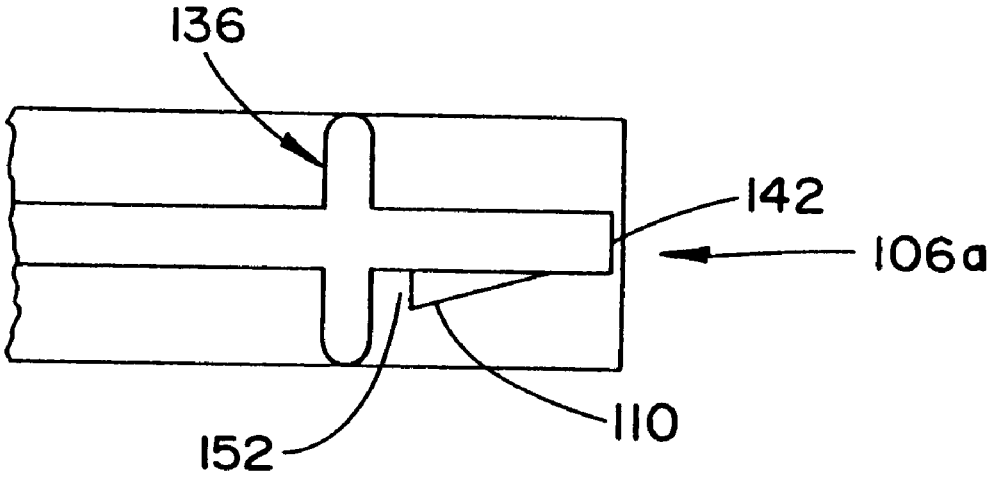
FIG. 4 illustrates a partial sectional view of the first web of FIG. 3 as taken along line 4—4 thereof.
Figure 5:
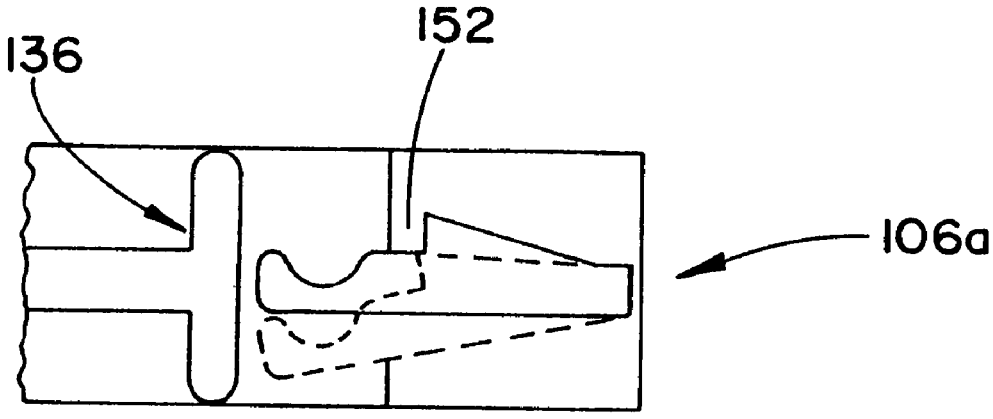
FIG. 5 illustrates a partial sectional view of the web of FIG. 3. as taken along line 5—5 thereof, the movement of the pivoting latch illustrated therein by a broken line.

Referring Now to FIG. 3*a*, the web has a fixed latch 110 and a pivoting latch 112. The pivoting latch 112 is preferably located at a central portion of the web 106*a* and the fixed latch 110 is located on at least one end of the pivoting latch 112. Preferably, the fixed latch 110, as shown in FIG. 3, comprises two abutments 110*a*, 110*b* located on each end of the pivoting latch 112. As illustrated in FIGS. 4–7, and most clearly in FIGS. 6*a* and 6*b*, it is also preferable that the pivoting latch 112 projects from a first side 114 of the web 106*a* and the fixed latch 110 projects from an opposite side 116 of the web 106*a*.

Referring back to FIG. 3*a*, the pivoting latch 112 is preferably defined by a slot 118 cut through the web 106*a*. The slot preferably has a shape defined by at least two sides 118*a*, 118*b*. The pivoting latch 112 is further defined by a living hinge, shown by dotted line 120 closing the shape of the slot 118. As shown in FIG. 3*a*, the slot 118 is preferably substantially two sided 118*a*, 118*b* and the living hinge 120 closes the shape of the slot 118 thereby forming a triangular shaped pivoting latch 112. It should be apparent to those skilled in the art that the pivoting latch and the slot defining the shape thereof, can have a variety of shapes, such as rectangular, without departing from the scope or spirit of the present invention.

Figure 6A:
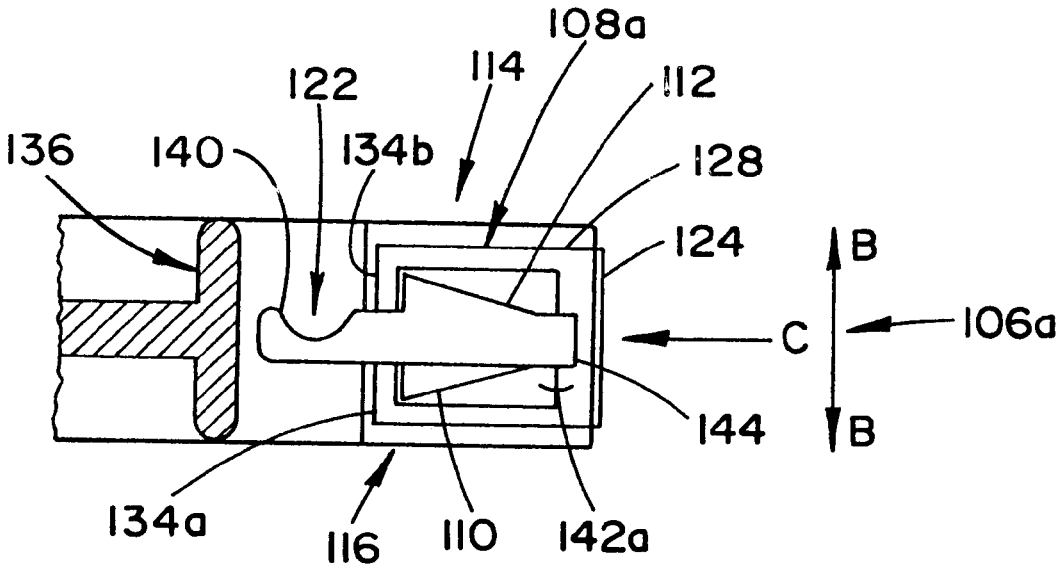
FIG. 6(*a*) illustrates a partial sectional view of the web of FIG. 3 as taken along line 5—5 thereof and additionally having the first version of the size indicator secured thereon.
Figure 7A:
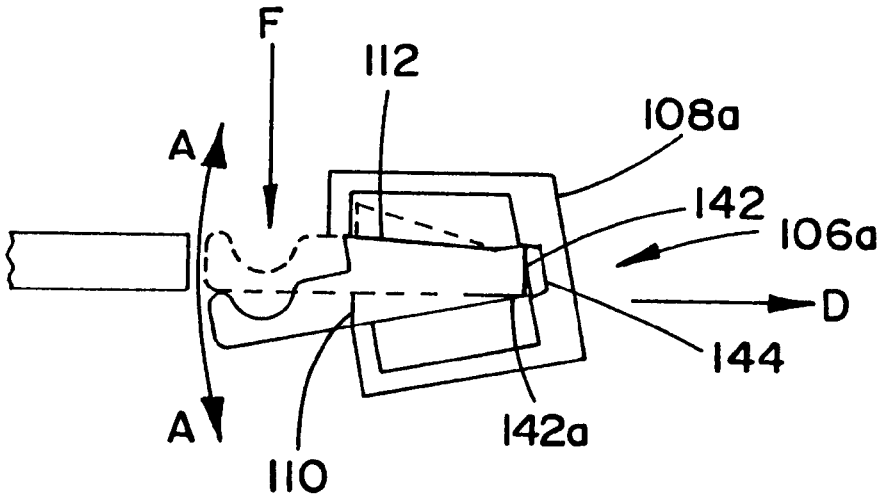
FIG. 7(*a*) illustrates the first web and first version of the first embodiment of the size indicator of FIG. 6(*a*) wherein the pivoting latch is being pivoted to release the size indicator therefrom.
Figure 7B:
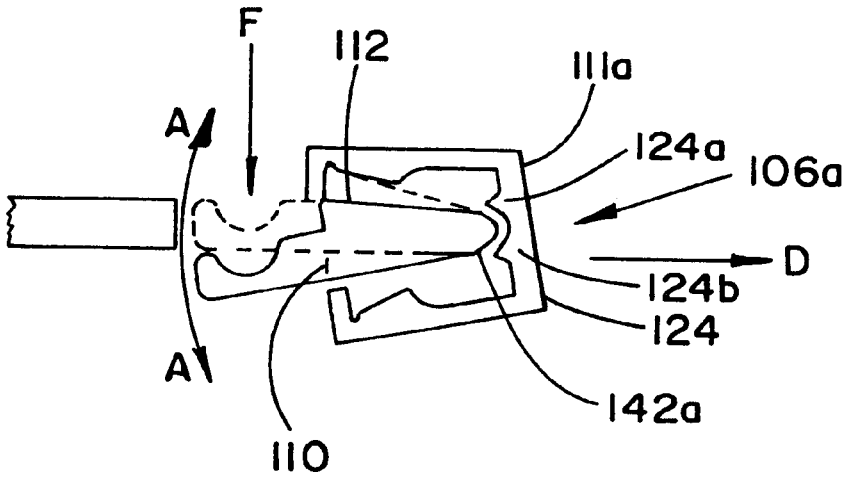

Referring now to FIGS. 3*a*, 3*b*, and 6*a* in combination, the pivoting latch 112 preferably has an engagement means for facilitating movement of the pivoting latch about arrow A shown in FIGS. 7*a* and 7*b*. The engagement means preferably comprises a cantilevered end 122 of the pivoting latch 112 which when a releasing force (F) is applied thereto provides a mechanical advantage for movement of the pivoting latch 112 out of engagement with the size indicator. Simultaneously, the opposite side of the pivoting latch 112 displaces the size indicator such that it no longer engages the fixed latch 110.

Figure 2C:
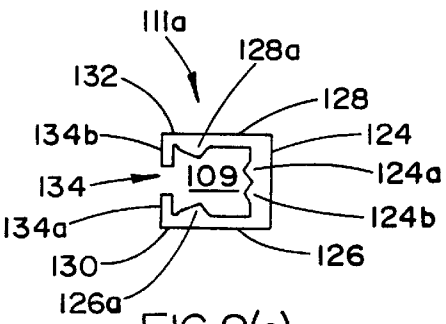
FIGS. 2(*a*) and 2(*c*) illustrate an end view of a first and second version, respectively, of a first embodiment of a size indicator of the present invention for engaging the first web of FIG. 1.
Figure 2B:
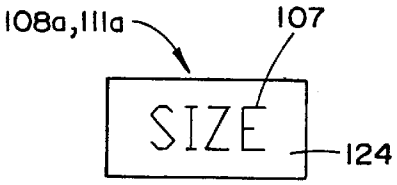
Figure 2A:
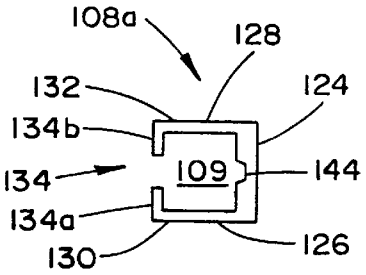

Referring now to FIGS. 2*a*, 2*b*, and 6*a* in combination, a first version of the size indicator 108*a* of the first embodiment generally has a face 124 and two sides 126, 128 depending therefrom to form a generally C-shaped channel 109. Each of the sides 126, 128 terminate in a foremost edge 130, 132. The foremost edges 130, 132 are preferably configured such that the cantilevered end 122 of the pivoting latch 112 is exposed when the size indicator 108*a* is secured on the web 106*a*.

The size indicator 108*a* further having finger means 134 for engaging the fixed and pivoting latches 110, 112, respectively, such that the size indicator 108*a* is secured on the web during normal use. However, the size indicator 108*a* is releasably secured on the web 106*a* such that it may be released from the web 106*a* when the pivoting latch 112 is pivoted out of engagement with the finger means 134 of the size indicator 108*a* when the release force (F) is applied. The finger means 134 preferably comprises an inwardly facing ridge 134*a*, 134*b* disposed at each of the foremost edges 130, 132 and projecting inwards towards the channel 109 of the size indicator 108*a*.

In an alternative version, a second size indicator of the first embodiment is illustrated in FIG. 2*c* in which like reference numerals refer to similar features, the second size indicator being referred to generally by reference numeral 111*a*. The second size indicator 111*a* has engagement abutments 126*a* and 128*a* which protrude from the inside of the sides 126, 128, respectively, to touch the side walls of the fixed and pivoting latches 110, 112 when secured to the web 106*a*. As will be discussed below, the size indicator 111*a* further has a pair of spaced projections 124*a*, 124*b* projecting from an inner surface of the face 124.

Referring back to FIGS. 3*a* and 6*a* in combination, the web preferably also has a guard 136 extending across the web 106*a* and below the size indicator 108*a*. In a preferred implementation, the guard 136 has a down-turned portion 138 which follows the contours of the cantilevered end 122 to thereby enable access to the edges of the size indicator and the engagement means 122 but prevents inadvertent actuation of the pivoting latch 112. The cantilevered end and engagement means 122 are preferably configured to engage a tool (not shown) used for application of the releasing force (F). The engagement means is preferably a dimple 140 formed on a side of the cantilevered end 122. The tool having a tip substantially conforming to the shape of the dimple 140 and having a width such that it is not prevented from engaging the dimple 140 by the guard 136.

The web preferably also has an outermost edge 142 having an outermost portion 142*a* of a predetermined cross-section. The first version of the size indicator 108*a* having a trough 144 (FIG. 2*a*) with a mating cross-section substantially configured to receive the outermost portion 142*a* therein for preventing a lateral movement of the size indicator along direction B—B when the size indicator 108*a* is secured on the web 106*a*. The preferable predetermined cross-section of both the outermost portion 142*a* and the trough 144 is substantially rectangular. The second version of the size indicator 111*a* having first and second spaced projections 124*a* and 124*b*, respectively, which project from the inner surface of the face 124. The first and second projections 124*a*, 124*b* are spaced such that the outermost portion 142*a* is accepted therein when the size indicator 111*a* is secured on the web 106*a* to prevent lateral movement of the size indicator 111*a* along direction B—B (illustrated in FIG. 6).

The engagement abutments 126*a*, 128*a* cooperate with the trough 144 or the first and second spaced projections 124*a*, 124*b* to prevent side to side movement of the size indicator on the web and contribute to a secure and solid attachment of the size indicator tot he hanger.

Referring to FIG. 3*b*, the web 106*a* further comprises locating means for locating the size indicator 108*a*, 111*a* in a predetermined position on the web 106*a*. The locating means preferably comprises first and second guides 146*a*, 146*b* disposed adjacent each side edge 148*a*, 148*b* of the size indicator 108*a*, 111*a* and spaced apart to align the size indicator 108*a*, 111*a* therebetween and to center the size indicator 108*a*, 111*a* during application thereof on the web 106*a*. Preferably, the first and second guides 146*a*, 146*b* do not extend the full length of the side edges 148*a*, 148*b* of the size indicator but define elongate openings 150*a*, 150*b* which expose the side edges 148*a*, 148*b* of the size indicator.

Referring now to FIGS. 6*a* and 7*a*, the operation of the garment hanger 100*a* of the present invention will be explained with regard to size indicator 108*a*. Size indicator 108*a* is mounted on the web 106*a* by sliding it over web 106*a* in the direction of arrow C. While being mounted in the direction of arrow C, the pivoting latch 112 pivots in the direction of arrow A until the inwardly facing ridges 134*a*, 134*b* of finger means 134 pass over the fixed and pivoting ridges 110, 112. After which, the inwardly facing fingers 134*a*, 134*b* snap into place in an area defined by the guide 136 and a bottom edge of the fixed and pivoting ridges 110, 112, the area being referenced by reference numeral 152 (illustrated in FIGS. 4 and 5). As such, the size indicator 108*a* is releasably secured on the web 106*a*.

Figure 6B:
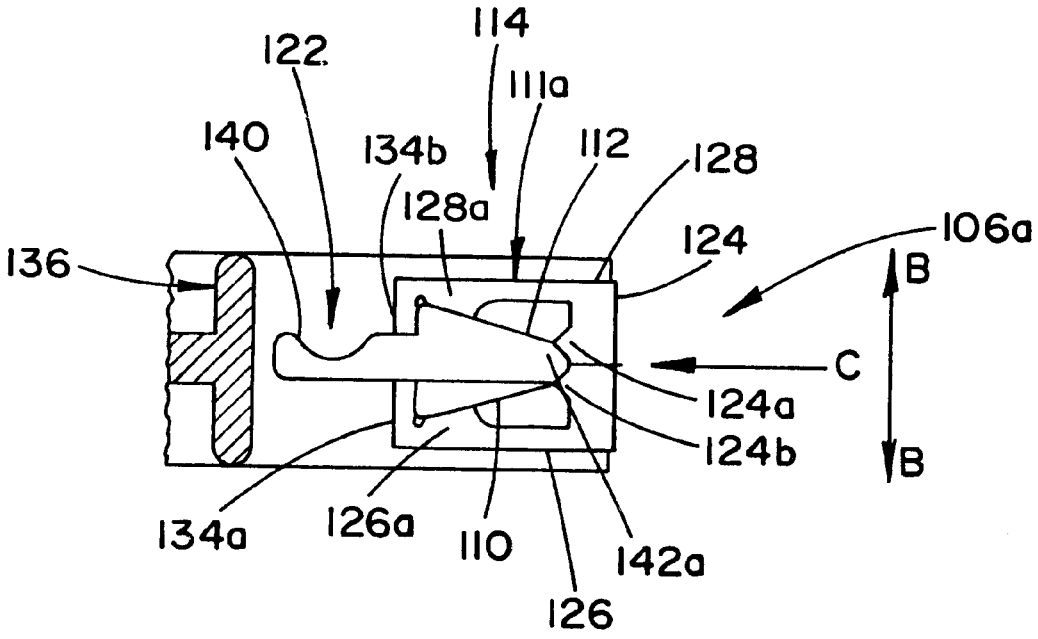

Referring now to FIGS. 6*b* and 7*b*, the operation of the garment hanger 100*a* of the present invention will be explained with regard to second version of the first embodiment of the size indicator 111*a*. Similar to the manner in which size indicator 108*a* is mounted, size indicator 111*a* is mounted on the web 106*a* by sliding it in the direction of arrow C over web 106*b*. While being mounted in the direction of arrow C, the pivoting latch 112 pivots in the direction of arrow A until the inwardly facing ridges 134*a*, 134*b* of finger means 134 pass over the fixed and pivoting ridges 110, 112. After which, the inwardly facing fingers 134*a*, 134*b* snap into place in an area defined by the guide 136 and a bottom edge of the fixed and pivoting ridges 110, 112, the area being referenced by reference numeral 152 (illustrated in FIGS. 4 and 5). Simultaneously, the engagement abutments 126*a* and 128*a* touch and engage with a face of the fixed and pivoting latches, 110, 112, respectively. As such, the size indicator 111*a* is releasably secured on the web 106*a*.

To release the size indicators 108*a*, 111*a* from the web 106*a*, a releasing force (F) is applied to the cantilevered end 122 of the pivoting latch 112, preferably by engaging the dimple 140 thereon with a release tool (not shown). The release force (F) results in the pivoting latch 112 to pivot about the living hinge 120 in the direction of arrow A. As can be seen in FIGS. 7*a* and 7*b*, planar side wall of the pivoting latch 112 causes the inner ridge 134*a* of the finger means 134 of size indicators 108*a*, 111*a* to extend past the furthest extending portion of the fixed latch 110. At this point, the size indicator 108*a*, 111*a* may be manually removed from the web 106*a*.

Preferably, the size indicators 108*a*, 111*a* are fabricated from a resilient material and thereby the sides 126, 128 may be slightly biased towards each other. Thus, when the side 126 of the size indicator 108*a*, 111*a* extends past the furthest extending portion of the fixed latch 110 the resilient bias of the size indicator 108*a*, 111*a* pops the size indicator off of the web automatically, without further manual intervention.

Preliminary testing of the releasable size indicators 108*a*, 111*a* of the present invention has indicated that a force of approximately 25–30 pounds is needed to pull the size indicators from the latches of the web. Thus, the size indicators 108*a*, 111*a* of the present invention are considered to be child-proof, since industry standards require a minimum force of 15 pounds to pull off a size indicator from a hanger for the size indicator to be considered child-proof.

Referring now to FIGS. 8, 9*a*, 9*b*, and 10, there is illustrated a second embodiment of the garment hanger of the present invention, generally referred to by reference numeral 100*b* and in which like reference numeral denote like elements as previously discussed. The garment hanger 100*b* differs from garment hanger 100*a* illustrated in FIG. 1 in that a second web 106*b* is disposed at a top portion 102*a* of the hook 102. Generally, the second web 106*b* differs from the first web 106*a* by the inclusion of first and second pivoting latches 212*a*, 212*b*.

Figure 10:
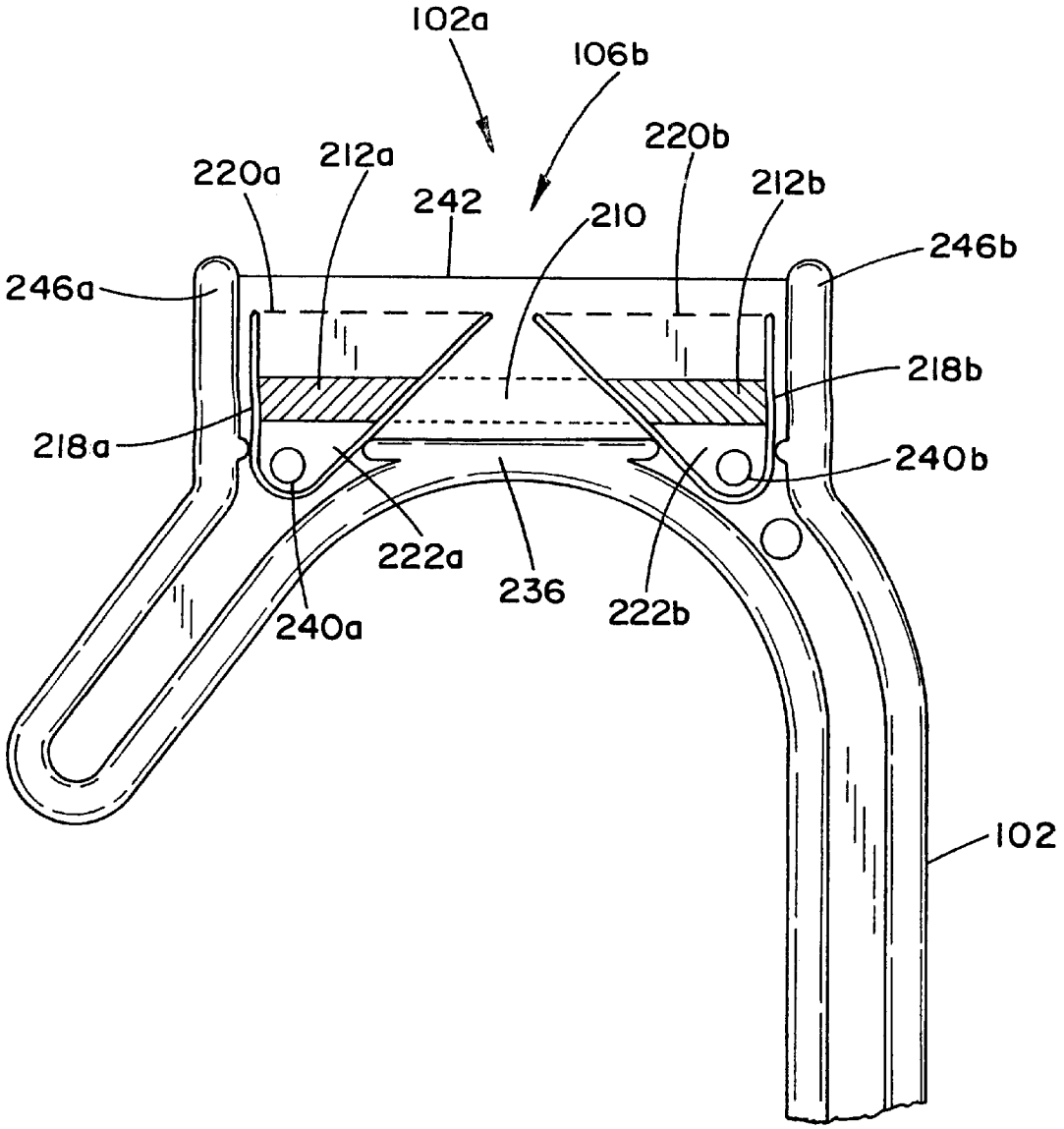
FIG. 10 illustrates an enlarged view of the second web of FIG. 1.

Referring Now to FIG. 10, the web 106*b* has a fixed latch 210 and first and second pivoting latches 212*a*, 212*b*. The fixed latch 210 is preferably located at a central portion of the web 106*b* and each of the pivoting latches 212*a*, 212*b* is located each end of the fixed latch 210. As with hanger 100*a* it is preferable that the pivoting latches 212*a*, 212*b* project from a first side of the web 106*b* and the fixed latch 210 project from an opposite side of the web 106*b*.

Referring back to FIG. 10, each pivoting latch 212*a*, 212*b* is preferably defined by a slot 218*a*, 218*b* cut through the web 106*b*. Each slot preferably has a triangular shape as discussed above with regard to hanger 10*a*. Each slot 218*a*, 218*b* is defined by a living hinge, shown by dotted lines 220*a*, 220*b* closing the shape of each slot 218*a*, 218*b*.

As discussed above with regard to hanger 100*a*, each pivoting latch 212*a*, 212*b* preferably has an engagement means for facilitating movement of the pivoting latch. The engagement means preferably comprises a cantilevered end 222*a*, 222*b* of the pivoting latch 212*a*, 212*b* which when the releasing force (F) is applied thereto provides a mechanical advantage for movement of each pivoting latch 212*a*, 212*b* out of engagement with a first or second version of a second embodiment of a size indicator 108*b*, 111*b*, respectively.

Figure 9A:
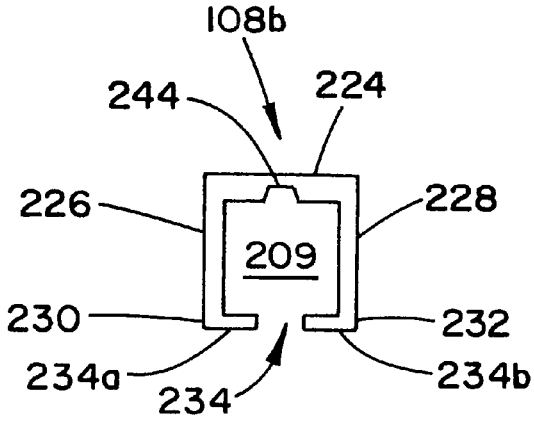
FIGS. 9(*a*) and 9(*c*) illustrate an end view of a first and second version, respectively, of a second embodiment of a size indicator of the present invention for engaging the second web of FIG. 1.
Figure 9B:
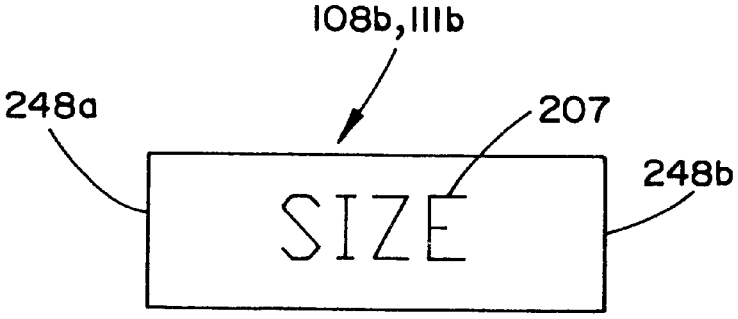

Referring now to FIGS. 9*a* and 9*b*, in combination, the first version of the second embodiment of the size indicator 108*b* generally has a face 224 and two sides 226, 228 depending therefrom to form a generally C-shaped channel 209. Each of the sides 226, 228 terminate in a foremost edge 230, 232. The foremost edges 230, 232 are preferably configured such that the cantilevered end 222*a*, 222*b* of each of the pivoting latches 212*a*, 212*b* are exposed when the size indicator 108*b* is secured on the web 106*b*.

Figure 9C:
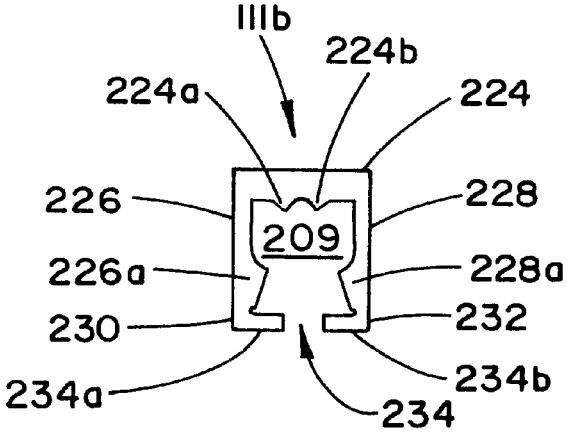

In an alternative version, a second size indicator of the second embodiment is illustrated in FIG. 9*c* in which like reference numerals refer to similar features, the second size indicator of the second embodiment being referred to generally by reference numeral 111*b*. The second size indicator 111*b* has engagement abutments 226*a* and 228*a* which protrude from the inside of the sides 226, 228, respectively.

The first and second size indicators 108*b*, 111*b* of the second embodiment further have finger means 234 for engaging the fixed and pivoting latches 210, 212*a*, and 212*b*, respectively, such that the size indicators 108*b*, 111*b* are secured on the web 106*b* during normal use. However, the size indicators 108*b*, 111*b* are releasably secured on the web 106*b* such that they may be released from the web 106*b* when both of the pivoting latches 212*a*, 212*b* are pivoted out of engagement with the finger means 234 of the size indicators 108*b*, 111*b* when a release force is applied. The finger means 234 preferably comprises inwardly facing ridges 234*a*, 234*b* disposed at each of the foremost edges 230, 232 and projecting inwards towards the channel 209 of the size indicators 108*b*, 111*b*.

Although a size indication can be disposed on either the top or side surfaces of the second size indicators 108*b*, 111*b* of the second embodiment, it is preferable that the size indicators 108*a*, 111*a* of the first embodiment have the size indication 107 disposed on the face 124 of the size indicator

108*a*, 111*a*, and the size indicators 108*b*, 111*b* of the second embodiment have the size indication 207 on both sides 226, 228 of the size indicator 108*b*, 111*b*.

Referring to FIG. 10, the web 106*b* preferably also has a mounting hedge 236 extending partially across the web 106*b* and below the size indicator 108*b* to provide external support for the edges 230, 232 of the size indicator. Each of the cantilevered ends and engagement means 222*a*, 222*b* are preferably configured to engage a tool (not shown) used for application of the releasing force (F). The engagement means is preferably a dimple 240*a*, 240*b* formed on a side of each of the cantilevered ends 222*a*, 222*b*. The tool being configured as described above with regard to hanger 100*a*.

The web 106*b* preferably also has an outermost edge 242 having an outermost portion as described with regard to hanger 100*a*. The size indicator 108*b* having a trough 244 (FIG. 9*a*) with a mating cross-section substantially configured to receive the outermost portion therein for preventing a lateral movement of the size indicator when the size indicator 108*b* is secured on the web 106*b*. The preferable predetermined cross-section of both the outermost portion and the trough 244 is substantially rectangular. The second version of the second embodiment of the size indicator 111*b* has first and second spaced projections 224*a* and 224*b*, respectively, which project from the inner surface of the face 224. The first and second projections 224*a*, 224*b* are spaced such that the outermost portion is accepted therein when the size indicator 111*b* is secured on the web 106*a* to prevent lateral movement of the size indicator 111*b* along direction B—B.

The web 106*b* further comprises locating means for locating the size indicators 108*b*, 111*b* in a predetermined position on the web 106*b*. The locating means are formed from reenforcing webs of the hanger hook and preferably comprises first and second guides 246*a*, 246*b* disposed adjacent each side edge 248*a*, 248*b* of the size indicators 108*b*, 111*b* and spaced apart to align the size indicators 108*b*, 111*b* therebetween and to center the size indicators 108*b*, 111*b* during application thereof on the web 106*b*.

The operation of the hanger 100*b* of the second embodiment of the present invention operates substantially equivalently to that of the hanger 100*a* of the first embodiment. It should be apparent to those skilled in the art that both pivoting latches 212*a*, 212*b* are pivoted by application of the release force to release the size indicators 108*b*, 111*b* from the web 106*b*.

Figure 11:
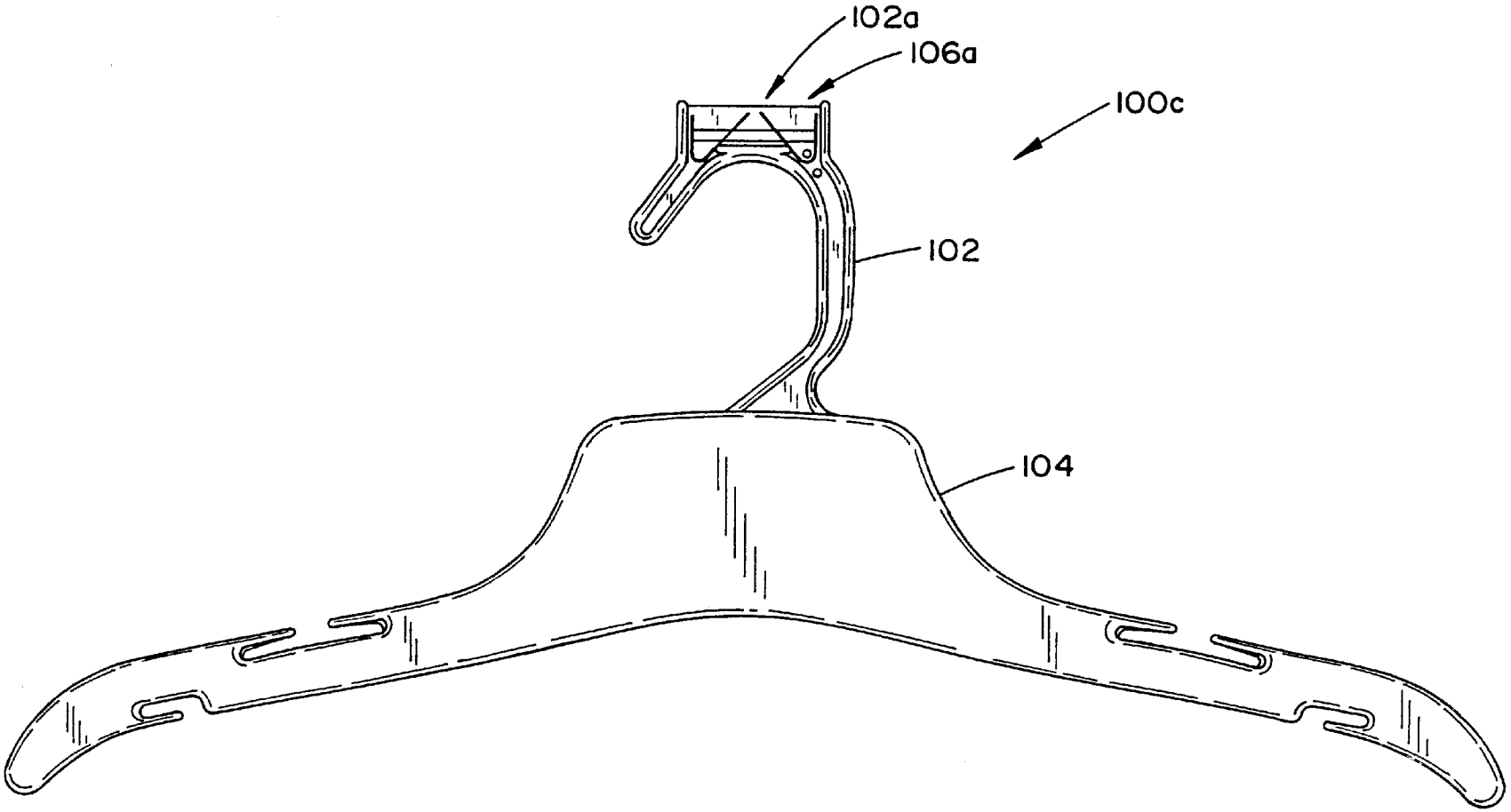
FIG. 11 illustrates a third embodiment of a garment hanger of the present invention having the second web at the top portion of the hook.

FIG. 11 illustrates a hanger of a third embodiment of the present invention generally referred to by reference numeral 100*c*. The hanger 100*c* of the third embodiment of the present invention is similar to that of the second embodiment (hanger 100*b*) with the exception of the elimination of side sizer web 106*a*.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A size indicator to be removably secured to a web of a garment hanger, the size indicator comprising a face and two sides depending therefrom defining a channel, each of the sides terminating in a foremost edge, the face having a pair of spaced projections substantially configured to receive an outermost portion of the web therebetween for preventing a lateral movement of the size indicator when the size indicator is secured on the web, each of the sides having an engagement abutment disposed between the face and foremost edge and an inwardly facing ridge disposed at each of the foremost edges and projecting inwards towards the channel for engaging a fixed ridge and a pivoting ridge on the web.

* * * * *